United States Patent [19]

Ruhe et al.

[11] 4,326,897

[45] Apr. 27, 1982

[54] POST WELD HEAT TREATMENT OF SHELL AND TUBE HEAT EXCHANGERS AND APPARATUS

[76] Inventors: Anthony Ruhe, 1310 Pelham St., Box 791; John A. Chitty, 2 Peachtree Park, both of Fonthill, L0S 1E0, Ontario; James H. D. Nickerson, 71 Cherie Rd., St. Catharines, L2R 6L6, Ontario, all of Canada

[21] Appl. No.: 46,122

[22] Filed: Jun. 6, 1979

[30] Foreign Application Priority Data

Apr. 26, 1979 [CA] Canada ..... 326458

[51] Int. Cl.[3] ..... C22F 1/00; C21D 9/08; C21D 11/00

[52] U.S. Cl. ..... 148/13.1; 148/14; 148/16; 148/16.7; 148/20.3; 148/127; 266/90; 266/99; 266/251; 266/252; 266/258

[58] Field of Search ..... 148/128, 127, 16, 16.7, 148/20.3, 13.1, 14, 13.2; 266/99, 251, 252, 258, 81, 85, 87, 88, 90

[56] References Cited

U.S. PATENT DOCUMENTS

| | | | |
|---|---|---|---|
| 2,311,344 | 2/1943 | Machlet | 266/254 |
| 2,429,320 | 10/1947 | Kennedy | 148/127 |
| 2,626,792 | 1/1953 | Maxwell et al. | 432/224 |
| 2,705,627 | 4/1955 | Norgaard | 432/224 |
| 4,070,147 | 1/1978 | Sikora et al. | 432/224 |
| 4,229,235 | 10/1980 | Matsuda et al. | 148/127 |

*Primary Examiner*—R. Dean

*Attorney, Agent, or Firm*—John E. Wilson; Marvin A. Naigur; John J. Herguth, Jr.

[57] ABSTRACT

An apparatus and method is provided for heat treating a tubular type heat exchanger. A heat fluid is passed through the tube bundle in order to heat the exchanger from within.

20 Claims, 3 Drawing Figures

POST WELD HEAT TREATMENT OF SHELL AND TUBE HEAT EXCHANGERS AND APPARATUS

BACKGROUND OF THE INVENTION

This invention relates to an apparatus and method for post weld heat treatment of large tubular heat exchangers, and more particularly for post weld heat treatment of nuclear steam generator components.

High pressure heat exchangers are usually manufactured by welding together a plurality of metallic members, including relatively thick cylindrical shell sections, headers, tube sheets and a bundle of tubes. Governing Codes often require welded sections to be heat treated in order to relieve stresses. In addition to meeting the governing codes, it may be required to heat treat the complete tube bundle to reduce residual stresses in the tubes due to manufacturing operations. This reduction of residual stresses may have metallurgical benefits to the life and integrity of the tubing in service. One of the most common mehtods of stress relieving large heat exchangers has been to heat the exchanger inside a furnace. Pursuant to this method hot gases contact the outer surfaces of the exchanger, and the exchanger thereby absorbs heat. This method not only requires that the exchanger be heat treated for a relatively long time, in some cases a week or more, but also may create large temperature differentials between some of the parts of the heat exchanger. For example, large temperature differentials may exist within the tube bundle between the inner and outer tube regions and also in the tubesheet. These large temperature differentials can be experienced when the heat exchanger is being heated up to a desired temperature level, while it is being held at a desired temperature level, or while it is being cooled down to ambient temperature. As a consequence of these temperature differences thermal stresses can be induced in parts of the heat exchanger. Although longer and slower heat treatment in a furnace may lessen the likelihood of inducing thermal stress, it would increase the time during which the shell portion of the heat exchanger is exposed to heat, and consequently the strength and impact properties of the shell would deteriorate. An additional consequence of the temperature differentials could be that the required heat treatment temperature is not reached in all regions of the tube bundle.

The present invention provides an apparatus and method for heat treating heat exchangers, including nuclear steam generators and components thereof, whereby large temperature differentials between heat exchanger elements can be eliminated, yet heat treatment can be completed in a relatively short time.

SUMMARY OF THE INVENTION

In accordance with an illustrative embodiment demonstrating features and advantages of the present invention, there is provided a method and apparatus for heat treatment of a tubular heat exchanger which includes a shell and a bundle of tubes disposed therein.

The method aspect of the invention includes steps of heating a fluid in a heating means, passing the heated fluid through the tube bundle, measuring the temperature of the heat exchanger at a plurality of points therein and controlling the rate at which the fluid is heated.

The apparatus of the present invention comprises means for passing a heating fluid into the heat exchanger, means for heating the fluid, means for measuring the temperature of the heat exchanger at a plurality of points therein, and means for contolling the amount of heat applied to the tubes.

DESCRIPTION OF THE PREFERRED EMBODIMENT

Figure 1:
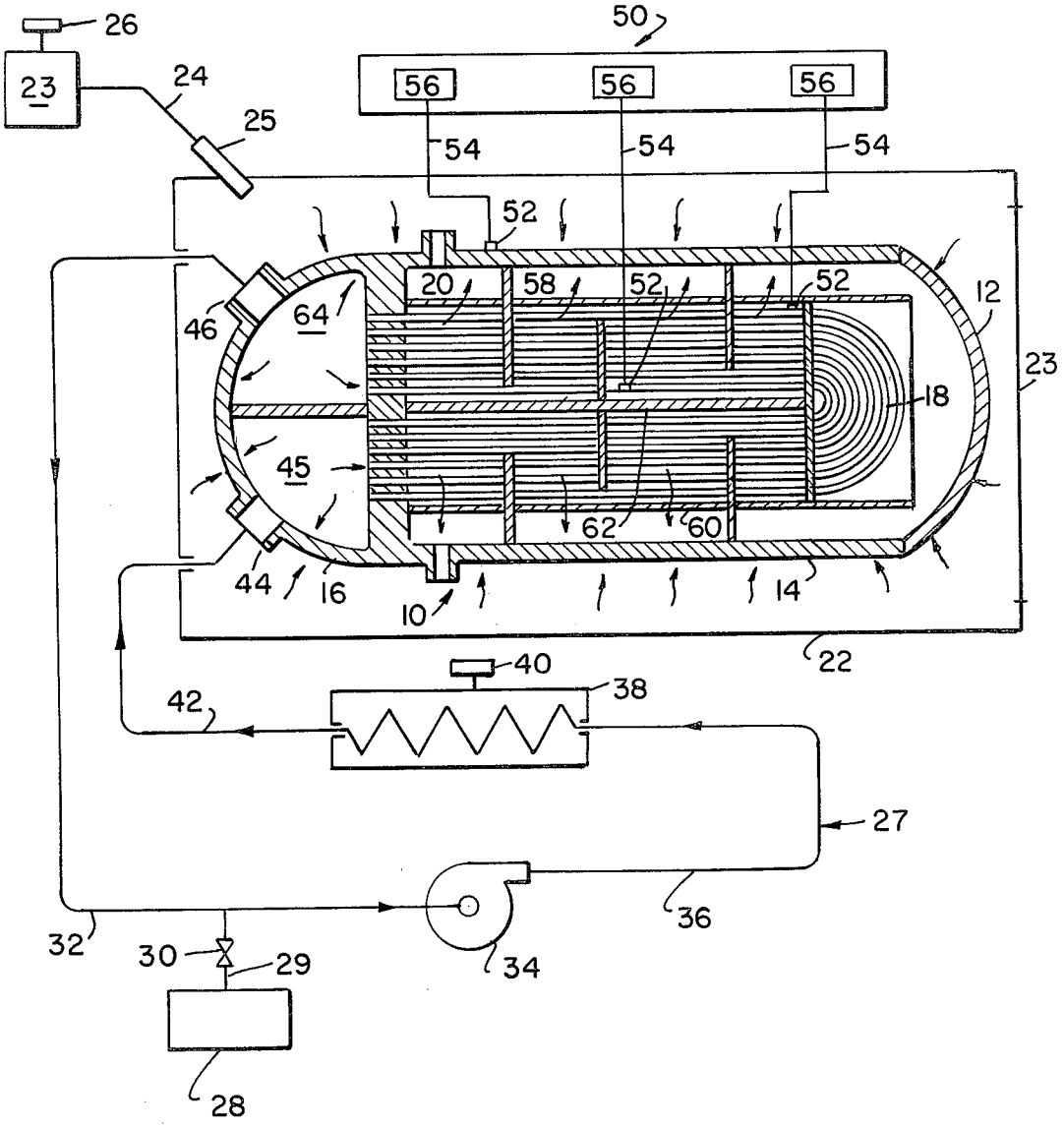
FIG. 1 is a schematic illustration of the heat treatment apparatus of the present invention in which a nuclear steam generator component is shown being heat treated from within the tube bundle and from outside the shell.

Referring to FIG. 1, a schematic illustration of the apparatus aspect of the invention is represented. In FIG. 1 a tubular type heat exchanger 10 is shown, which comprises the steam generating section of a nuclear steam generator. Heat exchanger 10 includes many different elements such as header 16, shell 14, tube bundle 18, and tube sheet 20 which have been welded together and require heat treatment. A temporary closure 12 is fastened to shell 14 before the treatment begins. It is to be understood that the present invention has application to many other tubular type heat exchangers, such as feed water heaters and/or reheaters for example, and therefore the invention is not intended to be limited to use with the particular heat exchanger shown.

Heat exchanger 10 is disposed within a furnace 22 which applies heat to the outside surfaces of heat exchanger 10. Furnace 22 includes a door 23 which can be opened for insertion or removal of heat exchanger 10. Furnace 22 can be one of several types of furnaces including electric, gas or oil fired furnaces. In the preferred embodiment a gas fired furnace is employed. A gaseous fuel, such as natural gas, is supplied from a source 23 through a line 24 to a burner 25. The fuel is burned in burner 25 and yields a hot gas which is applied to the outer surfaces of heat exchanger 10. A control means 26, such as a valve, is provided for controlling the amount of fuel supplied to burner 25.

A fluid flow circuit generally designated 27 is provided for passing a heating fluid through the tube side of the heat exchanger 10. A source 28 of heating fluid such as nitrogen or air provides heating fluid through conduit 29 and valve 30 into conduit 32. It should be understood that the fluid is preferably inert, in order to avoid corrosion or contamination of the heat exchanger components through which it passes, but need not be inert for purposes of heat treatment of the heat exchanger 10. In the preferred embodiment nitrogen is used as heating fluid.

A forced circulation means 34 forces the fluid through the circuit 27. In the preferred embodiment means 34 comprises a high temperature fan, but other means such as a pump may be employed dependent upon the fluid that is passed through circuit 27. Another conduit 36 is connected between fan 34 and an external heater 38. External heater 38 can be one of several types of heaters, but in the preferred embodiment it comprises an electric heater. Control means 40 are provided for regulating the operation of heater 38 so as to allow for controlling the temperature to which the heating fluid is heated.

Another conduit 42 is connected between heater 38 and heat exchanger 10. Conduit 42 communicates with an inlet 44 associated with header 16 of heat exchanger 10. In a similar manner conduit 32 communicates at one end with an outlet 46 associated with header 16 and fan 34 at its other end.

Means 50 are provided for measuring the temperature of various elements of heat exchanger 10. Means 50 comprises a plurality of sensing means 52, such as thermocouples, connected by circuits 54 to respective indicating means 56. In FIG. 1 means 50 are arranged so as to allow for measurement of the temperatures of the outside surface of shell 14, the outside surface of the innermost tube making up bundle 18, and the outside surface of the outermost tube making up bundle 18. It is to be understood that the temperature of other parts of the heat exchanger can be measured, and therefore the invention is not to be limited to the arrangement shown in FIG. 1.

During the operation of the embodiment of the invention shown in FIG. 1 an initial charge of heating fluid is introduced from fluid source 28 through conduit 29 and valve 30 into conduit 32. The fluid is forced through circuit 27 by fan 34. As the fluid passes through external heater 38 heat is applied to it, with control means 40 being operated to regulate the amount of heat added to the fluid. Heated fluid passes from heater 38 through conduit 42, then through inlet 44 into chamber 45 of heat exchanger 10. The fluid thereafter flows through the tubes making up bundle 18, giving up some of its heat as it passes therethrough. Heat passes into and through the walls of the tubes and flows by radiation and convection to the other parts of the heat exchanger 10, such as tube supports 58, shroud 60, tube sheet 20, and plate 62. The heating fluid then empties into chamber 64, and returns through outlet 46 back into conduit 32. After a sufficient supply of heating fluid has been introduced to circuit 27, valve 30 is closed. The fluid in circuit 27 is recirculated through the heat exchanger to accomplish the required heat treatment.

The temperature of the heating fluid is varied as necessary by means 40 in order to control the rate at which the heat exchanger is heated from within. During the "heating up" phase of heat treatment the control means 40 would be operated in a manner to gradually raise the temperature of the heating fluid, which would result in a gradual increase in the temperature of the heat exchanger parts. During the "hold" phase of heat treatment control means 40 would be operated to maintain the temperature of the heating fluid at a desired level so as to keep the temperature of the heat exchanger parts at a desired level. During the "cooling down" phase of heat treatment control means 40 would be operated in a manner to gradually reduce the temperature of the heating fluid so as to reduce the amount of heat to be supplied to heat exchanger 10, and thereby reduce its temperature to desired level.

Simultaneous with the heating of heat exchanger 10 from within the tube bundle 18, the heat exchanger 10 is heated from its outside by furnace 22. Just as the amount of heat added to the circulating heating fluid was controlled by means 40, the amount of heat supplied by furnace 22 is regulated, for example, by controlling the flow of gaseous fuel to burner 25 by means 26. Through the use of means 50, and the controls 26, 40, the heat supplied for treatment of heat exchanger 10 can be closely controlled, and temperature differences between parts of heat exchange 10 can be maintained at a desired level.

Figure 2:
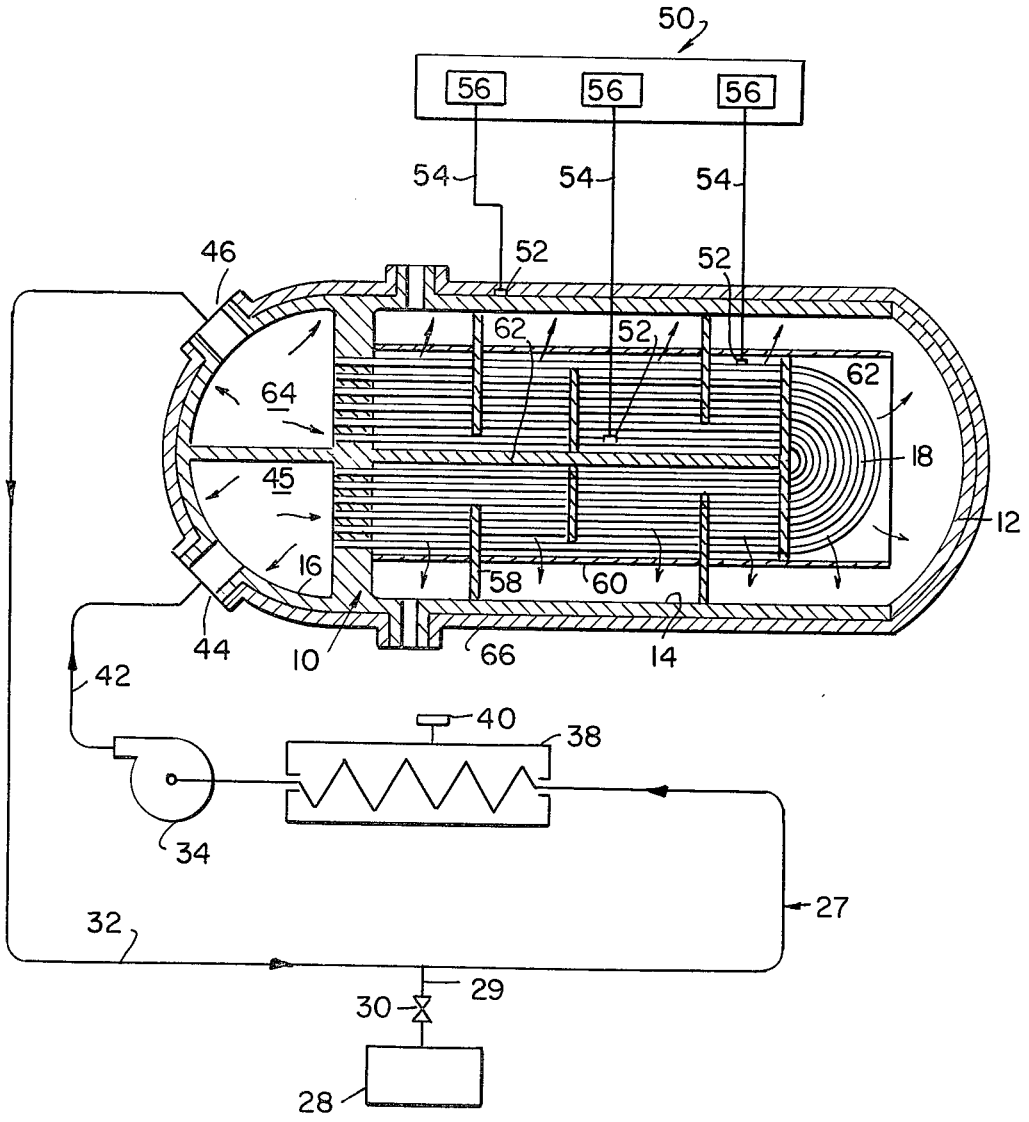
FIG. 2 is a schematic illustration of a second embodiment of the invention in which a nuclear steam generator component is shown being heated from within the tube bundle while the shell portion of the component is insulated on its outside.

An alternative embodiment of the apparatus aspect of the invention is shown in FIG. 2. In this embodiment fan 34 is disposed downstream of external heater 38, and supply means 26 is disposed upstream of heater 38. Rather than using a furnace to heat the heat exchanger 10 from outside, in this embodiment insulation 66 is disposed around the outside surface of the exchanger 10. Heat is provided by recirculating the heating fluid through circuit 27 into and through heat exchanger 10. Tube bundle 18 transfers heat by radiation and/or convection to the other elements of the heat exchanger 10, while insulation 66 retards loss of heat to the atmosphere.

Figure 3:
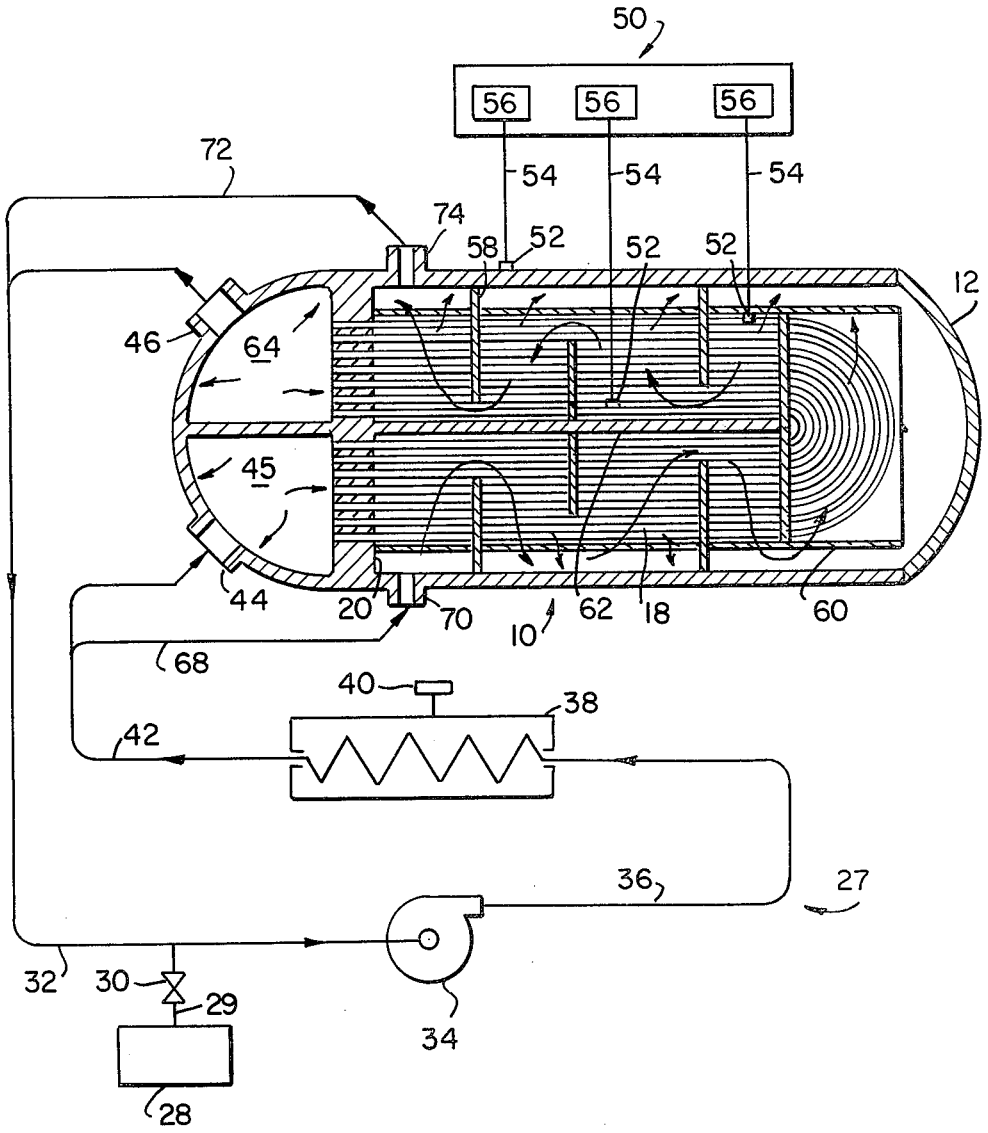
FIG. 3 is a schematic illustration of the invention in which a nuclear steam generator component is shown being heated from within the tube bundle and from within the shell portion of the component.

In FIG. 3 another embodiment of the apparatus aspect of the invention is shown. In this embodiment circuit 27 is connected to the shell side as well as the tube side of exchanger 10. A branch conduit 68 is connected between conduit 42 and an inlet 70 associated with shell 14. Another branch conduit 72 is connected between an outlet 74 for shell 14, and conduit 32. In the operation of this embodiment heating fluid passes through the tube side of heat exchanger 10, while heating fluid also flows within shell 14. The flow of shell side fluid is depicted by arrows in FIG. 3. It is to be understood that the embodiment of FIG. 3 could be augmented by employing either the furnace 22 shown in FIG. 1 or the insulation 66 shown in FIG. 2.

A latitude of modification, change and substitution is intended in the foregoing disclosure and in some instances some features of the invention will be employed without a corresponding use of other features. Accordingly, it is appropriate that the appended claims be construed broadly and in a manner consistent with the scope and spirit of the invention herein.

What is claimed is:

1. A method of heat treating a welded tubular type heat exchanger, said heat exchanger including a shell and a plurality of tubes disposed therein, said method comprising the steps of:

(a) establishing a fluid flow circuit for circulating a heating fluid from an external source through said heat exchanger;
(b) introducing a heating fluid to said circuit;
(c) applying heat to said fluid;
(d) circulating said heated fluid from said flow circuit through said heat exchanger;
(e) measuring the temperature of said heat exchanger at a plurality of points within said heat exchanger;
(f) increasing the amount of heat applied to said fluid so as to gradually raise the temperature of said fluid and said heat exchanger to a predetermined level;
(g) maintaining said increased temperature of said heating fluid and said heat exchanger at said predetermined level for a predetermined period of time; and
(h) decreasing the amount of heat applied to said fluid, so as to gradually reduce the temperature of said fluid and said heat exchanger, whereby during said heat treatment temperature differentials between said shell and said tubes are minimized.

2. The method of claim 1 wherein said step of circulating said heated fluid through said heat exchanger comprises introducing said fluid through respective first ends of said tubes disposed within said shell, flowing said fluid through said tubes, and thereafter removing said fluid from respective other ends of said tubes.

3. The method of claim 1, said shell of said heat exchanger having inlet and oulet openings formed therethrough wherein said step of circulating said heated fluid through said heat exchanger comprises introducing said fluid into said inlet, flowing said fluid over the outer surfaces of said tubes, and removing said fluid from said outlet formed in said shell.

4. The method of claim 1 wherein said step of passing said heated fluid through said heat exchanger comprises passing a first portion of said fluid into respective first ends of said tubes, flowing said first portion through said tubes, and removing said first portion from respective other ends of said tubes; and passing a second portion of said heated fluid into said inlet formed in said shell, said second portion passing over outer surfaces of said tubes, and removing said second portion from said outlet formed in said shell.

5. The method of claim 2, 3, or 4 further comprising the steps of applying heat to the outside surfaces of said heat exchanger, and regulating the amount of heat applied to the outside surfaces of said heat exchanger.

6. The method of claim 2 further comprising the steps of placing said heat exchanger within a furnace, burning a fuel within said furnace to liberate heat, and regulating the amount of heat applied to the outside surfaces of said heat exchanger.

7. The method of claim 2, 3, or 4 further comprising the step of attaching insulation around the outside surfaces of said heat exchanger, said insulation acting to retard loss of heat through the outside surfaces of said heat exchanger.

8. The method of claim 1 wherein said step of applying heat to said fluid comprises passing said fluid through an electric heater.

9. The method of claim 1 wherein said heating fluid comprises nitrogen, and wherein said step of passing said fluid through said circuit includes the step of passing said nitrogen through a high temperature fan whereby said nitrogen is forced through said fluid flow circuit.

10. A method of heat treating a welded tubular type heat exchanger, said heat exchanger including a shell, a tubesheet attached to said shell at one end thereof, a plurality of tubes disposed within said shell and secured to said tubesheet, means for introducing a fluid into said heat exchanger, and means for removing said fluid from said heat exchanger, said method comprising the steps of:

(a) connecting a conduit externally of said heat exchanger between said means for introducing fluid into said heat exchanger and said means for removing fluid from said heat exchanger;
(b) introducing a heating fluid from an external source into said conduit;
(c) forcing said heated fluid through said conduit and through said heat exchanger;
(d) applying heat to said fluid as it is forced through said conduit;
(e) measuring the temperature of said heat exchanger at a plurality of points within said heat exchanger;
(f) increasing the amount of heat applied to said fluid so as to gradually raise the temperature of said fluid and said heat exchanger to a predetermined level;
(g) maintaining the temperature of said fluid and said heat exchanger at a predetermined level for a predetermined period of time; and
(h) decreasing the amount of heat applied to said fluid so as to gradually reduce the temperature of said fluid and said heat exchanger, whereby during said heat treatment temperature differentials between said shell, tubesheet, tubes, means for introducing fluid, and means for reducing fluid are minimized.

11. An apparatus for post weld heat treatment of a tube type heat exchanger, said heat exchanger including a shell, a tubesheet attached to said shell, a plurality of tubes disposed within said shell and secured to said tubesheet, means for introducing a fluid into said heat exchanger, the means for removing said fluid from said heat exchanger, said apparatus further including:

(a) means for circulating a heating fluid through said heat exchanger;
(b) means for applying heat to said fluid;
(c) means for minimizing the temperature differentials between said shell, tubesheet, tubes, means for introducing fluid, and means for removing fluid, including
  (1) means for measuring the temperatures of said heat exchanger at a plurality of points within said heat exchanger; and
  (2) means for regulating the amount of heat applied to said fluid.

12. The apparatus of claim 11 wherein said means for circulating a heating fluid through said heat exchanger comprise a conduit disposed externally of said heat exchanger and connected between said means for introducing fluid to said heat exchanger and said means for removing fluid from said heat exchanger, a source of heating fluid, and means for passing said fluid from said source to said conduit.

13. The apparatus of claim 12 wherein means for introducing fluid to said heat exchanger includes means for introducing fluid into said shell and means for introducing fluid into said tubes, and wherein said means for removing fluid from said heat exchanger includes means for removing fluid from said shell and means for removing fluid from said tubes, said heating fluid flowing from said conduit into said tubes and into said shell in a parallel flow relationship.

14. The apparatus of claim 12 wherein said means for introducing fluid to said heat exchanger comprises a first opening formed in the shell of said heat exchanger, and said means for removing said fluid from said heat exchanger comprise a second opening formed in said shell of said heat exchanger and spaced apart from said first opening.

15. The apparatus of claim 13 wherein said means for introducing fluid to said heat exchanger comprises an inlet header section in flow communication with inlet ends of said tubes, and said means for removing fluid from said heat exchanger comprises an outlet header section in flow communication with outlet ends of said tubes.

16. The apparatus of claims 13, 14 or 15 further comprising means for applying heat to the outside surfaces of said heat exchanger.

17. The apparatus of claims 13, 14 or 15 further comprising insulation disposed around the outside surfaces of said heat exchanger.

18. The apparatus of claim 12 wherein said means for applying heat to said fluid comprises an electric heater.

19. The apparatus of claim 17 wherein said means for applying heat to the outside surfaces of said heat exchanger comprises a furnace.

20. The apparatus of claim 19 wherein siad furnace comprises a gas-fired furnace.

* * * * *